United States Patent [19]

Candland et al.

[11] Patent Number: 4,777,881

[45] Date of Patent: Oct. 18, 1988

[54] TEMPERATURE COMPENSATING ELECTRO-MECHANICAL BALLISTIC CONTROL TUBE SYSTEM

[75] Inventors: Calvin T. Candland, Eden Prairie; Steven P. Neubauer, Maple Grove; Warren E. Hawkins, Brooklyn Park, all of Minn.

[73] Assignee: Honeywell Inc., Minneapolis, Minn.

[21] Appl. No.: 65,480

[22] Filed: Jun. 23, 1987

[51] Int. Cl.[4] ..... F42B 5/02

[52] U.S. Cl. ..... 102/430; 102/472

[58] Field of Search ..... 102/430, 433, 434, 469, 102/470, 472

[56] References Cited

U.S. PATENT DOCUMENTS 4,197,801 4/1980 LeFever et al. .
4,335,656 6/1982 Bains .
4,478,128 10/1984 Black et al. .
4,691,638 9/1987 Meyer et al. .

*Primary Examiner*—Deborah L. Kyle
*Assistant Examiner*—Richard Klein
*Attorney, Agent, or Firm*—John G. Shudy, Jr.

[57] ABSTRACT

A temperature compensating ballistic control tube system for varying the volume containing primary propellant, for the purpose of affecting the effect of the propellant on the projectile in order to compensate for the effect of ambient temperature upon the performance of the primary propellant. The volume containing the primary propellant is changed by pushing the projectile away from the casing containing the primary propellant, down a gun bore by a piston of the ballistic control tube. The piston, pushing the projectile, is moved by an ignited secondary charge in the ballistic control tube. Electronic components detect initial movement of the piston and projectile and, after a certain delay, ignite the primary propellant thereby ejecting the projectile from the gun. A typical primary propellant, within a given volume, is temperature senstive, that is, it provides more force to the projectile at higher temperatures. Increasing the volume, by moving the projectile with the ballistic control tube piston before igniting the primary propellant, reduces the performance of the ejected projectile in accordance with an amount of delay inserted between the moments of initial movement of the piston and ignition of the primary propellant. The projectile is moved more prior to primary propellant ignition, at warmer temperatures so as to further increase the primary propellant volume since the cartridge is designed for maximum projectile performance at cold temperatures.

12 Claims, 4 Drawing Sheets

TEMPERATURE COMPENSATING ELECTRO-MECHANICAL BALLISTIC CONTROL TUBE SYSTEM

The United States Government has rights in this invention pursuant to Contract No. DAAK11-84-C-0102, awarded by AMCCOM of the United States Army.

BACKGROUND OF THE INVENTION

The present invention relates generally to munitions and particularly to control of propellants of projectiles. More particularly, the invention pertains to control of propellants to effect greater performance of projectiles under adverse environmental conditions.

Projectile munitions have varied performance dependent on environmental temperatures. Propellants of the munitions typically provide high performance under high ambient temperatures. Under cold conditions such munitions exhibit low performance due to the slower burn rate or degradation of propellants. To increase performance of cold munitions, the temperature of propellants may be increased. However, such heated munitions may be dangerous if designed for maximum performance under colder environmental conditions. So for reasons of safety of firing crews and of avoiding excessive stress on firing mechanisms, most munitions are designed for high ambient temperatures. Such design results in low performance munitions at medium or low temperature climatic conditions. One ad hoc solution has been to warm up munitions in such environments. However, combatant conditions afford little luxury in maintaining munitions at a desirable temperature. Such techniques are hazardous and cumbersome. The related art does not afford direct solution to the problems associated with cold munitions.

SUMMARY OF THE INVENTION

The present invention solves the problem of munitions' inability to maintain full performance characteristics under any temperature condition of an environment. The degrading effect of cold temperatures upon propellants of munitions is noted. Compensation in the present invention utilizes the degrading effect of increased chamber volume upon stored propellants.

The primary object of the invention is to provide munitions with optimal performance at all or a selected range of environmental temperatures. The invention varies the volume of the container of the main propellant for the projectile according to ambient temperature of the propellant. If the temperature is low, the volume of the propellant case is kept at a minimum. For a relatively high temperature, the volume of the case is enlarged proportionately. The enlargement is achieved by moving the projectile forward from the main charge or propellant case with an internal piston of a ballistic control tube put into motion by a secondary charge or propellant.

In a related invention, entitled "Temperature Compensating Ballistic Control Tube," filed by Steven P. Neubauer, on Apr. 23, 1987, Ser. No. 041499, owned by the same assignee as the present invention, an advantage is taken of the secondary charge's or propellant's being temperature sensitive, that is, the higher the temperature the greater the force created by the charge. The secondary charge or propellant is contained in a relatively constant volume thereby ensuring a greater force at higher temperature. This greater force moves the projectile via the internal piston of the ballistic control tube at a greater initial velocity at the time the main propellant is ignited, thereby increasing the case volume and, in turn, decreasing the peak pressure produced by the main propellant for a given temperature. At lower temperatures, the force of the secondary charge or propellant is lower, thus moving the projectile at a slower velocity by the time of ignition of the main propellant, thereby not increasing the case volume of the main propellant as fast and, in turn, maintaining a peak pressure similar in magnitude to that at higher temperatures of the main charge or propellant. The ideal is for the projectile to have optimal performance at any environmental temperature, i.e., temperature independent performance. However, the temperature sensitivity of the secondary charge may not be great enough to produce complete compensation. The present invention solves this problem with electronic control of the ignition of the primary charge.

A feature of the present invention is the electronic ignition system which measures the temperature of the propellant and produces the time delay between the ignition of the control tube (secondary charge) and the main (primary) charge that is needed to produce the desired peak pressure. Generally the desired peak pressure is the maximum safe pressure allowed for the particular type of gun that is used. In the invention, initially, the secondary propellant is ignited, either mechanically or electrically. The ignited secondary propellant moves a piston fitted as part of a ballistic control tube. The piston shears a break tab which sets into operation an electronic temperature sensor and delay circuit. The piston also moves the projectile forward thereby increasing the volume of the case containing the main propellant. After a precisely determined delay from the time of the shearing of the break tab, the electronic circuit triggers the ignition mechanism for the main propellant. The amount of delay is dependent on the temperature of the main charge. The higher the temperature, the greater the delay and, consequently, the greater the chamber volume when the main charge is ignited. Further, the delay of the circuit is adjustable according to the type of propellant. The electronic circuit has the flexibility to produce whatever time delay is required to reduce the peak pressure of a given temperature main charge to the maximum safe value. In contrast, it may not always be possible in the related art to find a secondary charge with sufficient temperature sensitivity to produce the needed peak pressure control over a range of main charge temperatures.

DETAILED DESCRIPTION OF THE PREFERRED EMBODIMENT

Figure 1:
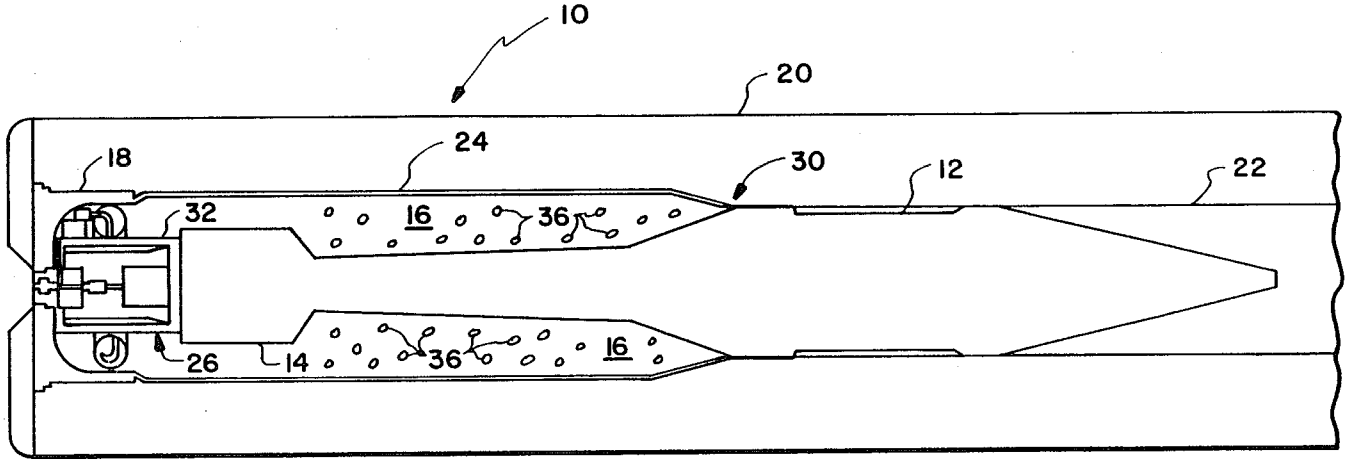
FIG. 1 shows a munition incorporating the present invention.
Figure 2:
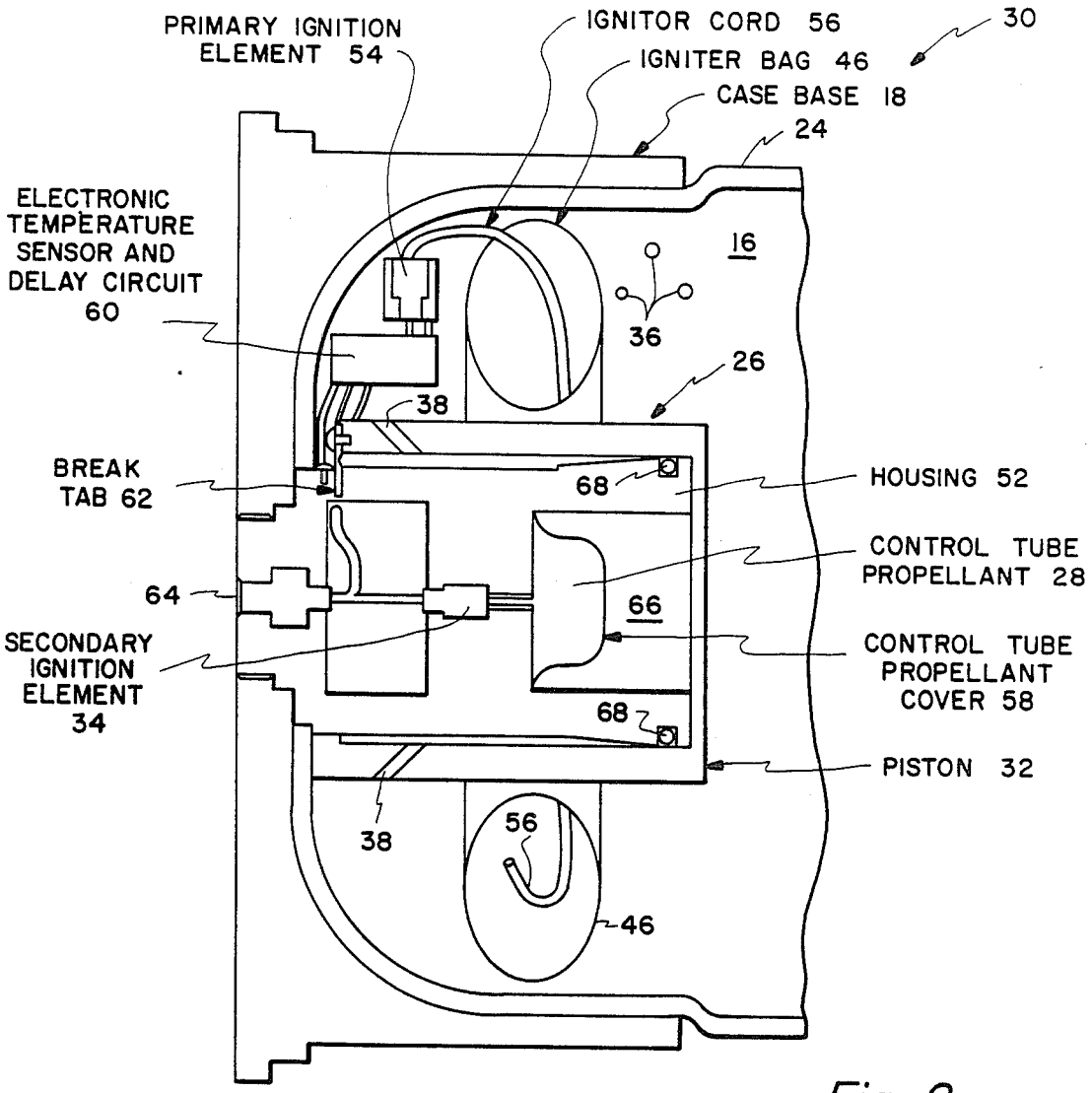
FIG. 2 shows details of the invention as incorporated in the munition.

FIG. 1 shows weapon 10 having ammunition 30 positioned in chamber and barrel 20. Bore 2 of barrel 20 is designed so that projectile 12 may move through bore 22. Volume 16 within case 24 contains main propellant or charge 36. Base case 18 supports ballistic control tube 26. At the base end of control tube 26 is secondary ignition element 34 for igniting secondary charge or control tube propellant 28 as shown in FIG. 2. Piston 32 is supported against fins 14 of projectile 12.

Ammunition 30 is designed so that projectile 12 exits bore 22 at optimal velocity under environments of various temperatures. Main propellant 36 for a given volume provides greater average pressures behind the propellant at higher temperatures. If the same amount of main propellant 36 is in volume 16 that is increased, then the pressure behind projectile 12 is reduced. If the amount of main propellant 36 packed into volume 16 is such that volume 16 is at its minimum for maximum performance of projectile 12 at the coldest temperature that ammunition 30 is subjected to, then maximum performance of projectile 12 may be maintained for any operating temperature higher than the coldest temperature. This operability having peak performance without exceeding the safety limits of munition 30 at various temperatures above the coldest temperature that munition 30 is designed to operate at, is accomplished by increasing volume 16 which in turn reduces the effect of main propellant 36 upon projectile 12 for a given temperature. This volume 16 increase is accomplished by the movement of projectile 12 down bore 22. The forward movement of projectile 12 for increasing volume 16 is accomplished by secondary propellant or charge 28. Secondary propellant 28 forces piston 32 against fins 14 of projectile 12 thereby accomplishing a movement of projectile 12 down bore 22.

FIG. 2 illustrates in greater detail the interrelationship of electronics 60 of the invention with munition 30. When ammunition 30 is fired, a firing signal is first received from weapon 10 at contact point 64. The electrical firing signal coming through contact point 64 goes to secondary ignition element 34 which ignites control tube propellant or secondary charge 28 which is enclosed within control tube propellant cover 58. Also the firing signal coming at contact point 64 is a power supply voltage to electronic temperature sensor and delay circuit or electronics 60. When control tube propellant 28 is ignited, it forces control tube propellant cover 58 loose from housing 52. Gases of propellant 28 in secondary charge chamber 66 expand, exerting pressure on piston 32. Piston 32 is fitted on housing 52 and is moveable in a direction away from case base 18 in such a fashion as to push on fins 14 of projectile 12. O-ring 68 seals the gases within control tube chamber 66 as piston 32 is moving away from housing 52. As piston 32 is about to move due to the expanding gases of secondary propellant 28 in chamber 66, break tab 62 breaks and opens a circuit which results in a signal to electronic temperature sensor and delay circuit 60, thereby starting a timer in the delay circuit of electronics 60. After a certain amount of time after the break tab has been broken, a signal is sent from electronics 60 to primary ignition element 54 causing primary ignition element 54 to ignite igniter cord 56. Igniter cord 56 in turn ignites igniter bag 46. Igniter bag 46 ignites main propellant 36 in volume 16 of case 24. The timing or delay between the time of the breaking of break tab 62 and the starting of primary ignition element 54 due to a signal from electronic temperature sensor and delay circuit 60, depends on the temperature sensed by electronics 60 within volume 16 of casing 24. If the temperature of volume 16 and primary charge 36 is relatively hot, the delay between the breaking of break tab 62 and the firing of primary ignition element 54 is relatively long. This allows for piston 32 to move a large distance, thereby pushing against fins 14 of projectile 12, and moving projectile 12 a significant distance down bore 22, thus increasing the amount of volume 16. An increase in volume 16 reduces the pressure that primary propellant 36 would have exerted on projectile 12. Because the temperature is relatively high, primary propellant 36 burns at a faster rate than it would at colder temperatures. On the other hand, if munition 30 is in a very cold environment, volume 16 is kept at a minimum so as to maintain the maximum pressure of primary propellant 36 when ignited. Under very cold conditions, the receipt of a firing signal at contact point 64 ignites ignition element 34 and provides a voltage supply to electronics 60. The igniting of secondary ignition element 34 causes control tube propellant 28 to ignite and force off control tube propellant cover 58 and cause the expansion of gases of secondary propellant 28 in volume 66, thereby forcing piston 32 to move in a direction away from case base 18. As piston 3 moves, break tab 62 breaks, resulting in an open circuit signal to the electronic temperature sensor and delay circuit of electronics 60, thereby causing a timing delay between the breaking of break tab 62 and the sending of a signal to ignite primary ignition element 54. Because the temperature of primary propellant 36 is cold, as sensed by electronics 60, the delay between the breaking of break tab 62 and the sending of a firing signal to primary ignition element 54 is at a minimum. Thus, piston 32 moves a very short distance, just sufficient to break break tab 62. Volume 16 is minimally expanded due to the pushing of projectile 12 by piston 32 down bore 22. This prevents any significant degradation of primary propellant 36 due to the increase of volume 16. On the other hand, lower volume 16, which causes greater pressures to be generated by primary propellant 36 than the pressures that primary propellant 36 would generate in greater volume 16, is compensated for by the cold temperature of primary propellant 36, which has a degrading effect upon primary propellant 36.

The delay provided by the electronic temperature sensor and delay circuit of electronics 60 between the breaking of break tab 62 and the firing of primary ignition element 54 is designed into the delay circuit in accordance with the characteristics of primary propellant 36 under various ambient temperatures and various volumes 16. The compensation provided by the delay of electronics 60 is such that the force provided to projectile 12 due to the pressures generated by primary propellant 36, is constant over a large range of temperatures from cold to hot. The advantages are that munition 30 provides maximum performance at very cold temperatures and yet provides the same level of performance at very hot temperatures, without resulting in dangerously high pressures in volume 16 caused by primary propellant 36 under high temperatures.

If electronic temperature sensor and delay circuit of electronics 60 fail when munition 30 receives a firing signal at contact point 64, the breaking of break tab 62 has no effect. This results in an indefinite delay of the firing signal from electronics 60 to primary ignition element 54. In this situation, the firing of ignition element 34 ignites control tube propellant 28, provides expanding gases in volume 66 and pushes piston 32, including projectile 12, a maximum distance, thereby resulting in a maximum volume 16 for propellant 36. However, since primary ignition element 54 does not fire and consequently igniter cord 56 and 46 do not fire, primary propellant 36 appears to not be ignited. To prevent the situation where a failure of electronics 60 prevents primary propellant 36 from being ignited, the maximum movement of piston 32 down from housing 52 results in expanding gases in volume 66 to escape through vents 38 in piston 32. The gases of secondary propellant 28 escaping from vents 38 ignite primary propellant 36. Projectile 12 will have been moved a maximum distance down bore 22 thereby providing a maximum volume 16 within which primary propellant 36 results in its weakest forces due to expanding gases for a given temperature. At maximum temperatures, the pressures of ignited propellant 36 still will be safe.

The ignition of secondary propellant 26 resulting in expanding gases in volume 66 thereby forcing piston 32 down from housing 52 and away from case base 18, followed by the ignition of primary propellant 36, results in the ejection of projectile 12 only. Piston 32 is not ejected during a firing. Design of housing 52 and piston 32 is such that piston 32 comes to a tight fit around housing 52 when extended to a maximum distance from housing 52. Further, the pressures in volume 66 are no longer contained when piston 32 has moved its maximum distance since these gases are able to escape through vents 38. Thus, vents 38 have a two-fold purpose: to ignite primary propellant 36 when electronics 60 has failed; and to relieve gases from volume 66 after a normal firing of munition 30 when electronics 60 has functioned appropriately.

Figure 3:
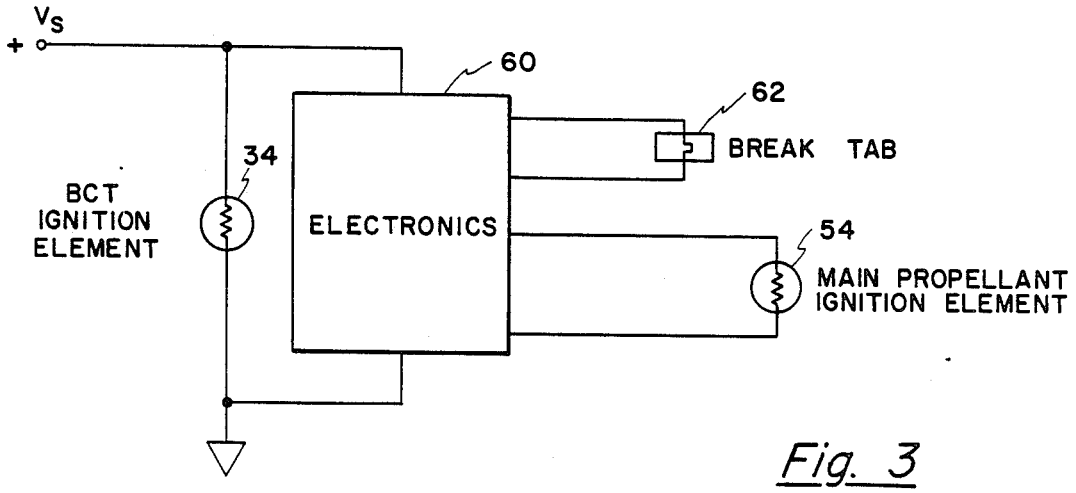
FIG. 3 illustrates the interrelationship of the electronics within the munition.

FIG. 3 is a simple block diagram of the interconnections of electronics 60 of the temperature compensating electro-mechanical firing circuit for munition 30. The voltage supply for electronics 60 and ballistic control tube ignition element 3 is provided at contact point 64 in FIG. 2. Break tab 62, as illustrated in FIG. 3, becomes an open circuit starting a timed delay in electronics 60 up to the moment that main propellant ignition element 54 is ignited. Timing with break tab 62 is more advantageous than timing the delay between the arrival of a firing signal to ballistic control tube ignition element 34 and the igniting of main propellant ignition element 54. Break tab 62 senses the first movement of piston 32. Variables of delay dependent upon speed of the ballistic control tube ignition element 34, the dispersion of control tube propellant cover 58, the speed of pressure build-up of control tube propellant 28 in volume 66, and the temperature dependent performance characteristics of control tube propellant 28, are eliminated by the use of break tab 62.

Figure 4:
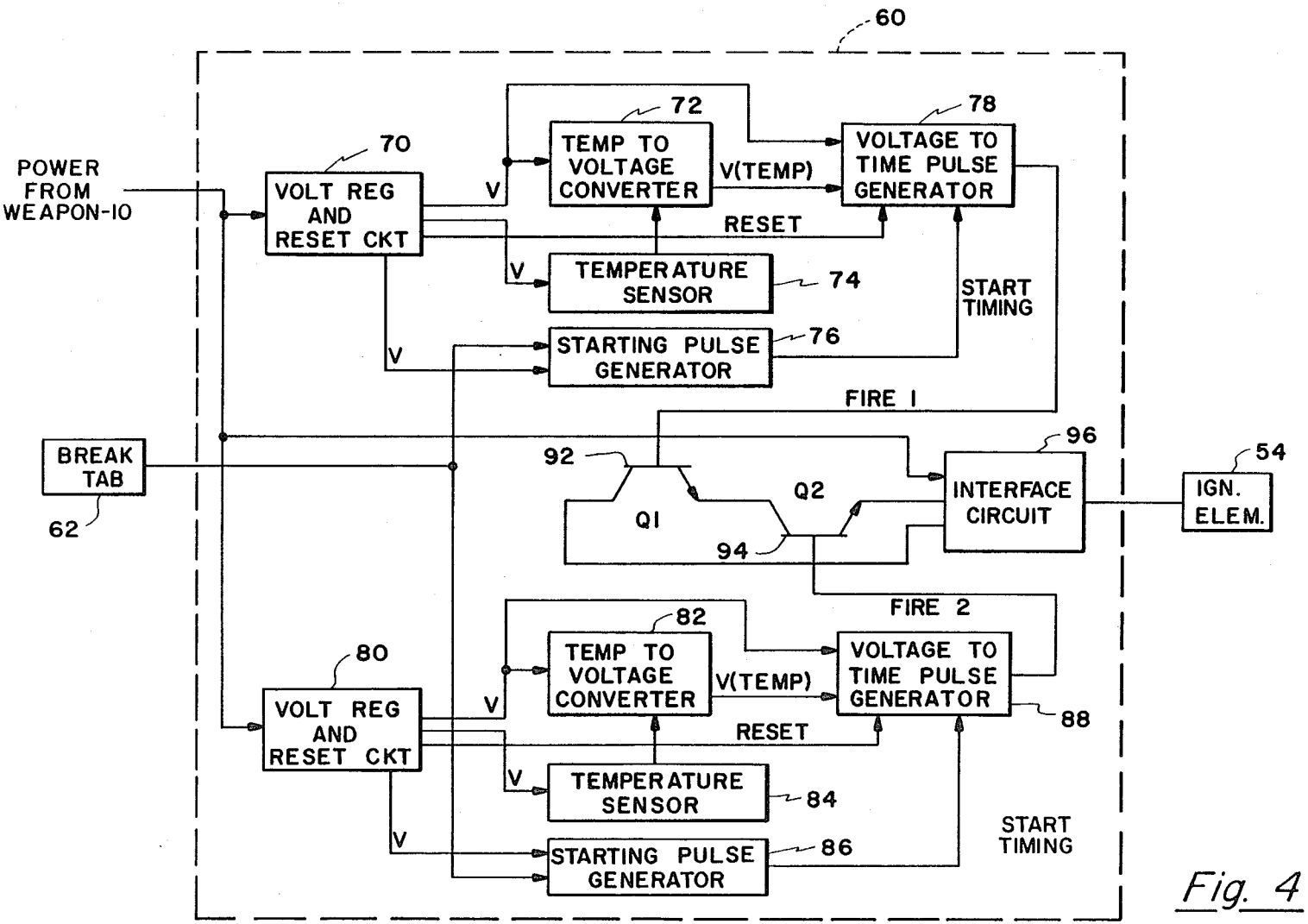
FIG. 4 is a block diagram of the electronics.

FIG. 4 shows a more detailed block diagram of the electronic temperature sensor and delay circuit of electronics 60. The firing signal arrives at contact point 64 of munition 30, with power from weapon 10 for electronics 60. The power is fed into voltage regulator and reset circuits 70 and 80. Voltage regulator and reset circuit 70 provides a voltage for temperature to voltage converter 72, temperature sensor 74 and voltage to time pulse generator 78. Voltage regulator and reset circuit 80 provides a voltage for temperature to voltage converter 82, temperature sensor 84 and voltage to time pulse generator 88. Voltage regulator and reset circuit 70 provides a reset signal to voltage to time pulse generator 78. Likewise, voltage regulator and reset circuit 80 provides a reset signal to voltage to time pulse generator 88. The reason, for the reset signals to voltage to time pulse generators 78 and 88, is a need for resetting the flip-flops in the voltage to time pulse generators 78 and 88. The circuits are kept in reset until all the supply voltages are up to operating levels. When break tab 62 is severed due to the movement of piston 32 in munition 30, an open signal begins starting pulse generators 76 and 86 which send start timing signals to voltage to time pulse generators 78 and 88, respectively. The start timing signals initiate voltage to time pulse generators 78 and 88 to countdown a particular delay in time from the breaking of break tab 62 to the moment that fire 1 signal and fire 2 signal are sent out from voltage to time pulse generators, 78 and 88, to switching transistors, 92 and 94, respectively. The fire 1 signal from voltage to time pulse generator 78 turns on transistor 92 and the fire 2 signal from voltage to time pulse generator 88 turns on transistor 94. Only when both transistors 92 and 94 are turned on by their respective fire signals, does current flow, from power supplied by weapon 10, through the junction of transistor 92 and the junction of transistor 94 to ignition element 54 thereby igniting ignition element 54. Ignition element 54 causes igniter cord 56 to fire igniter bag 46 which in turn ignites primary propellant 36. Both voltage to time pulse genertors 78 and 88 must simultaneously provide fire signals to transistors 92 and 94 in order excite ignition element 54. Merely one fire signal from either voltage to time pulse generator 78 or voltage to time pulse generator 88 is insufficient to ignite ignition element 54.

The delay of time, between break tab 62 being broken and the output of fire 1 signal of voltage to time pulse generator 78, is determined by a voltage from temperature to voltage converter 72. Temperature sensor 74 provides an indication to temperature to voltage converter 72 which in turn provides a voltage in proportion to the temperature sensed by temperature sensor 74. The higher the temperature sensed by temperature sensor 74, the greater the delay between the breaking of tab 62 and the output signal from voltage to time pulse generator 78. Similarly, the delay, between the breaking of break tab 62 and the fire 2 signal from voltage to time pulse generator 88, is determined by the level of voltage sent from temperature to voltage converter 82 to voltage to time pulse generator 88. Temperature sensor 84 indicates the ambient temperature and provides a certain amount of current to temperature to voltage converter 82 which in turn provides a voltage at a level indicative of the temperature to voltage to time pulse generator 88. The higher the temperature sensed by temperature sensor 84, the greater the delay between the time of the breaking of break tab 62 and the output of the fire 2 signal from voltage to time pulse generator 88 to transistor 94.

Figure 5:
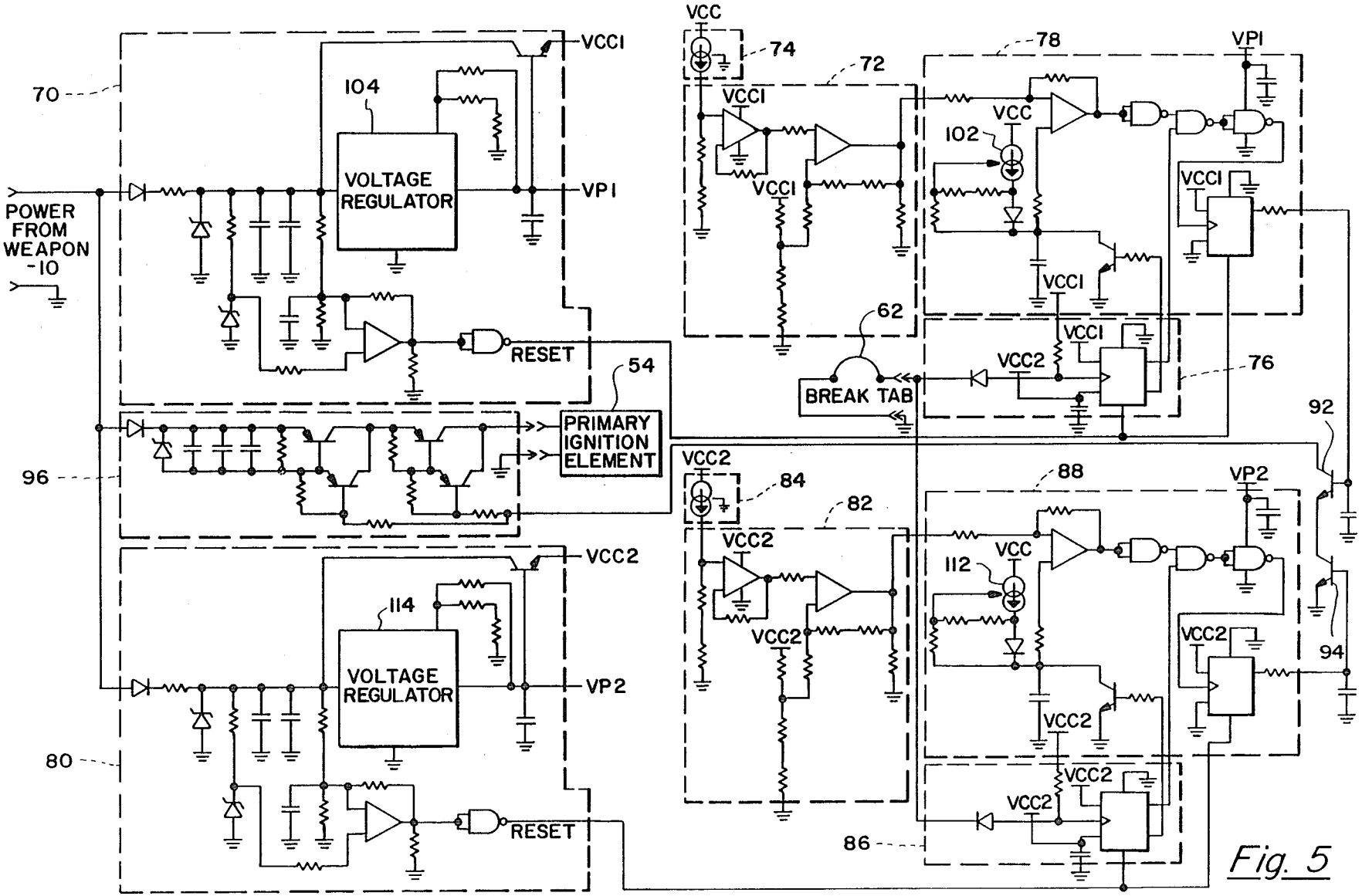
FIG. 5 is a schematic of the electronics.

FIG. 5 is a detailed schematic of electronics 60. All components are readily available at commercial electronic suppliers. Items 104 and 114 are standard integrated circuit voltage regulators selected in view of preferred voltage levels. Each of the temperature sensors, 74 and 84, is a temperature sensitive current source providing one microampere of current per degree Kelvin, e.g., 273 microamperes at 0° Centigrade. The specifications of temperature sensors 74 and 84 selected for electronics 60, may vary and the values of the components selected to accommodate sensors 74 and 84, may have values to effect certain preferred overall characteristics of electronics 60. Current sources 102 and 112 of voltage to time pulse generators 78 and 88, respectively, are temperature independent. The remaining numbered items correspond to like-numbered items in the above-discussed Figures.

The temperature compensating ballistic control tube system is constructed of parts, components and ingredients readily available on the market. The present system has secondary charge or control tube charge or propellant 28 composed of a small web JA2 propellant. Main propellant 36 is a JA2 stick propellant. Secondary ignition element 34 is an M83 igniter. Igniter bag 46 is a black powder igniter charge. However, the propellants and other elements of the described embodiment may be composed of other appropriate ingredients or parts.

What is claimed is:

1. A temperature compensating electro-mechanical ballistic control tube system comprising:

a first volume enclosed by a casing and a bore adjacent to the casing: and varying means, connected to said first volume, for varying said first volume, comprising:

a projectile connected to said first volume such that movement of said projectile varies said first volume;

a second volume enclosed by a cylinder-like container;

a piston connected to said second volume such that variation of said second volume corresponds to movement of said piston, and said piston in contact with said projectile such that said movement of said piston causes movement of said projectile;

a first combustible substance within said second volume;

first igniting means, connected to said first combustible substance, for igniting said first combustible substance which in turn expands said second volume by moving said piston thereby moving said projectile resulting in an increase in said first volume;

a second combustible substance within said first volume;

second igniting means, connected to said second combustible substance, for igniting said second combustible substance which in turn further expands said first volume by moving said projectile; and electronics means for connecting said piston to said second igniting means comprising:

temperature sensing means for sensing ambient temperature of said first volume; and delay means, connected to said temperature sensing means and to said second igniting means, for delaying a first ignition signal to said second igniting means, according an ambient temperature signal from said temperature sensing means.

2. Apparatus of claim 1 wherein said electronics means further comprises switching means, connected to said delay means, for providing the first ignition signal to said delay means.

3. Apparatus of claim 2 wherein said switching means is further connected to said piston such that upon initial movement of said piston, said switching means provides the first ignition signal to said delay means.

4. Apparatus of claim 1 wherein said electronics means further comprises a connecting means for connecting said first ignitor to said delay means such that upon a second ignition signal to said first igniting means, the first ignition signal is sent to said delay means.

5. Apparatus of claim 1 wherein said varying means further comprises connecting means, connected to said electronic means and to said piston, for providing said first ignition signal to said electonic means upon movement of said piston due to a second ignition signal to said first igniting means thereby igniting said first combustible substance causing an increase in said second volume resulting in the movement of said piston, in turn, causing movement of said projectile, thus, increasing said first volume for a duration of time determined by said electronics means according to the ambient temperature of said first volume, the duration of time being the the amount of time said first ignition signal is delayed prior to igniting said second igniting means, thereby igniting said second combustible substance and causing said projectile to be ejected from said first volume.

6. Apparatus of claim 5 wherein:

said projectile is a munition projectile; and said first volume is situated within a casing of a munition and a bore of a gun.

7. A temperature compensated munition comprising a first volume containing a first substance;

a projectile fitted to said first volume such that movement of said projectile varies said first volume; and temperature compensating means, connected to said first substance and to said projectile, for maintaining constant effect of said first substance upon said projectile, under various temperatures of said first substance, comprising:

electronic means for electronically implementing the constant effect of said first substance upon said projectile;

a second volume having a piston fitted to said second volume, the piston connected to said electronics means;

first igniting means, connected to said first substance and connected to said electronics means, for igniting said first substance;

first detector means, connected to said electroncs means, for detecting a change in said second volume; and second detector means, connected to said electronics means, for detecting ambient temperature of said first volume.

8. Apparatus according to claim 7 wherein said electronics means comprises delay means, connected to said first igniting means and to said first and second detector means, for providing a delay of an exciting signal to said first igniting means beyond the moment said first detector means detects a change in said second volume, the delay being determined in accordance with detected ambient temperature from said second detector means.

9. A temperature compensated munition comprising:

a casing, having a case base and a first volume, situated in a weapon having a gun bore;

a projectile, fitted to said casing like a piston and moveable down the gun bore of the weapon, movement of said projectile affecting amount of said first volume;

a ballistic control tube, attached to said case base of said casing, having a second volume and a moveable piston fitted to said ballistic control tube, movement of said piston affecting amount of said second volume and affecting the position of said projectile;

temperature compensating electonics, connected to said ballistic control tube, comprising:

a first temperature sensor located inside said casing;

a delay circuit connected to said temperature sensor; and a detector attached to said ballistic control tube and connected to said delay circuit;

a first ignitor situated inside said casing and connected to said delay circuit;

a second ignitor situated inside said ballistic control tube and connected to said temperature compensating electronics;

a first propellant substance situated within said casing; and a second propellant substance situated within said ballistic control tube.

10. Apparatus of claim 9 wherein said detector is a break tab switch, attached to said ballistic control tube and connected to said delay circuit, that sends a first ignitor signal to said delay circuit upon movement of said piston fitted to said ballistic control tube, said first ignitor signal delayed by said delay circuit according to a temperature signal from said first temperature sensor, and delayed said first ignitor signal sent to said first ignitor.

11. Apparatus of claim 9 wherein said delay circuit comprises:

a temperature to voltage converter connected to said first temperature sensor;

a voltage to time pulse generator connected to said temperature to voltage converter;

a starting pulse generator connected to said voltage to time pulse generator; and an interface circuit connected to said voltage to time pulse generator and to said first ignitor.

12. Apparatus of claim 9 wherein said delay circuit is a redundant circuit comprising:

a second temperature sensor located inside said casing;

a first temperature to voltage converter connected to said first temperature sensor;

a second temperature to voltage converter connected to said second temperature sensor;

a first voltage to time pulse generator connected to said first temperature to voltage converter;

a second voltage to time pulse generator connected to said second temperature to voltage converter;

a first starting pulse generator connected to said first voltage to time pulse generator;

a second starting pulse generator connected to said second voltage to time pulse generator; and an interface circuit connected to said first and second voltage to time pulse generators and connected to said first ignitor, requiring a fire pulse from both said first and second voltage to time pulse generators before an exciting signal is sent to said first ignitor.

* * * * *